United States Patent [19]

Chapman

[11] 4,142,436

[45] Mar. 6, 1979

[54] METHOD OF PLAYING STRINGED MUSICAL INSTRUMENT

[76] Inventor: Emmett H. Chapman, 8320 Yucca Trail, Los Angeles, Calif. 90046

[21] Appl. No.: 746,027

[22] Filed: Nov. 30, 1976

Related U.S. Application Data

[60] Continuation of Ser. No. 552,080, Feb. 28, 1975, abandoned, which is a division of Ser. No. 457,396, Apr. 3, 1974, Pat. No. 3,868,880, which is a division of Ser. No. 334,859, Feb. 22, 1973, Pat. No. 3,833,751.

[51] Int. Cl.[2] ..... G10D 3/06; G10H 3/08

[52] U.S. Cl. ..... 84/1.16; 84/173; 84/314; 84/DIG. 30

[58] Field of Search ..... 84/1.16, 173, 267–269, 84/284, 285, 312, 314, DIG. 30, 312 R

[56] References Cited

U.S. PATENT DOCUMENTS

| | | | |
|---|---|---|---|
| 963,588 | 7/1910 | Krienitz | 84/285 |
| 2,906,158 | 9/1959 | McBride | 84/173 X |
| 3,499,357 | 3/1970 | Peterson, Jr. | 84/285 |
| 3,525,797 | 8/1970 | Pavia | 84/1.16 X |

*Primary Examiner*—Stanley J. Witkowski
*Attorney, Agent, or Firm*—Irvin A. Lavine

[57] ABSTRACT

A method of playing a stringed musical instrument of the guitar family by tapping the strings. The musical instrument has, for example, a fretted fingerboard, a plurality of tensioned strings and string tensioning means, sound amplifying means; there is a first group of melody tuned strings and a second group of bass and chord strings. The strings of the first group are tapped by the fingers of the right hand and the strings of the second group are tapped by the fingers of the left hand. The fingers of both hands are used to tap bass, chords and melody simultaneously.

4 Claims, 7 Drawing Figures

AMPLIFIER & SYNTHESIZER
10
12
14
16
20
22
24
26
27
28
30
32
33
34
36
38
39
40
41
42
43
44
45
46
47
48
49
50
51
52
53
54
VI
VI

METHOD OF PLAYING STRINGED MUSICAL INSTRUMENT

CROSS REFERENCE TO RELATED APPLICATIONS

This is a continuation of application Ser. No. 552,080, filed Feb. 28, 1975, and now abandoned which is a division of application Ser. No. 457,396, filed Apr. 3, 1974, and now U.S. Pat. No. 3,868,880, which is a division of application Ser. No. 334,859, filed Feb. 22, 1973, and now U.S. Pat. No. 3,833,751.

BACKGROUND AND FIELD OF THE INVENTION

The present invention relates to the method of playing stringed musical instruments of the guitar family.

Instruments of the guitar family are characterized by the provision of an elongated fretted fingerboard having a plurality of tensioned strings immediately above the fingerboard, and means for amplifying the musical note produced by the vibrations of the strings when actuated as by being plucked by a plectrum or the user's fingers. In electric guitars, the sound amplifying means include a set of magnetic pickups, each pickup being close to a string, and the electrical outputs of the pickups are fed to electric amplifier devices of many different kinds. The electric guitar of the present invention is of this latter type, and has a body, preferably wooden, of generally rectangular cross-section consisting essentially of an elongated fretted fingerboard, a headpiece extending upwardly therefrom and a tailpiece extending downwardly therefrom. A magnetic pickup assembly is located near the tailpiece immediately above a set of tensioned strings attached to the tailpiece and headpiece.

From the musical viewpoint, a preferred instrument is characterized by the provision of a total of nine tensioned strings extending longitudinally immediately above the fretted fingerboard, and tuned in the following way: A first, highest pitched string; a second string tuned a perfect fourth interval below the first string; a third string tuned a perfect fourth interval below the second string; a fourth string tuned a perfect fourth interval below the third string; a fifth string tuned a perfect fourth interval below the fourth string; a sixth, lowest bass string tuned a major seventh interval below the fifth string; a seventh string tuned a perfect fifth interval above the sixth string; an eighth string tuned a perfect fifth interval above the seventh string; and a ninth string tuned a perfect fifth interval above the eighth string. Thus the third and ninth strings are tuned to the same pitch; the second string is tuned one octave above the eighth string; and the first string is tuned two octaves above the seventh string.

The provision of nine strings so tuned, when played with the fingers of both of the user's hands tapping the strings and holding them against selected frets, increases the chordal, melodic, and contrapuntal possibilities for producing a full, orchestral sound. By having his two hands free to engage nine strings, the performer is enabled to play bass, chords and melody simultaneously. There are strings for left-hand chords on both sides of the lowest pitched bass string (the sixth string in the series of nine). Normally, on this instrument chords are executed with the five strings tuned in intervals of fourths on one side of the lowest bass string, together with the three strings tuned in intervals of fifths on the other side of that bass string. Melody, however, is played almost exclusively on the first five strings tuned in fourth intervals. In effect, there are two groupings of strings partially overlapping the register covered. Melody played with the right hand in the upper portion of the fingerboard necessarily cancels out some of the notes on the left-hand chord in this method of two-handed playing. Thus the three strings not used for melody help to create the effect of the chord sustaining over the melody line.

One finger at one fret can tap and hold two or more strings at the same time. This technique allows easy and natural double, triple, or quadruple fourths or fifths in musical intervals, such intervals fitting in well with more complex chords. This capability is a result of the string tuning and, when exploited with the left hand, allows ease of chording, so that the performer can give more concentration to right-hand melody.

The string tuning of the present instrument, as described above, produces unusual and attractive musical results. First, the tuning of the first five strings, or "melody" strings, in uniform intervals of perfect fourths allows easy and natural transposition of chords and scale patterns from one combination of these strings to another. The tuning concept multiplies the opportunities for using a single chord or scale pattern, as contrasted with the case of a conventional guitar with its strings conventionally tuned, with a major third interval between the second and third strings. In the latter case, each chord and scale pattern must be individually learned. In the present instrument, this tuning principle of uniform intervals applies also to the sixth, seventh, eight and ninth strings, constituting the four "base and chord" strings.

Secondly, the two groupings of strings on either side of the lowest base string, overlap in the same register. Thus, chords using strings from both groupings contain intervals of major and minor seconds, which are easily and naturally fingered, as in the case of playing a piano.

Thirdly, ascending perfect fifth intervals on the second grouping of "base and chord" strings result in the same sequence of notes relative to each other as that produced by the descending perfect fourths of the melody strings.

Fourthly, tonal symmetry between the two groupings of strings heightens the logical relationship of bass to chords and to melody, since the first string is two octaves above the seventh string, the second string is one octave above the eighth string, and the third and ninth strings are the same note.

Accordingly, it is a principal object of the present invention to provide a unique method of playing a stringed musical instrument. It is another object of the present invention to provide a method wherein there will be increased the chordal, melodic and contrapuntal possibilities. Yet another object is to provide a method which will enable the production of a full, orchestral sound from an instrument of the guitar family. Still another object is to enable an instrument of this type to be played utilizing the fingers of both hands for tapping. Still another object of the present invention is the provision of right hand tapping of melody strings and left hand tapping of bass and chord strings.

DETAILED DESCRIPTION

Figures 1, 2, 3:
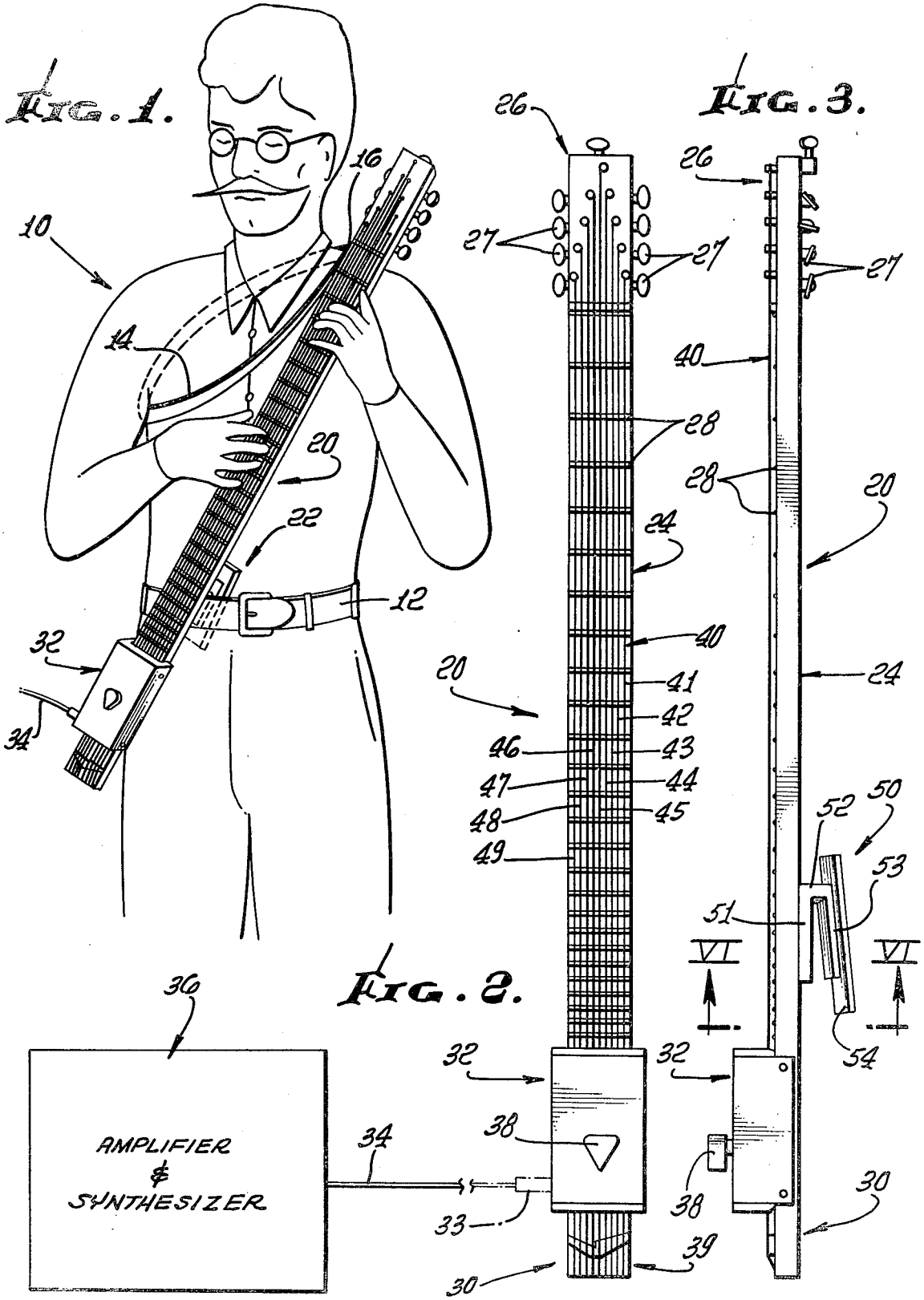
FIG. 1 is a front view of the upper portion of a performer's body, together with a guitar of the present invention shown in playing position.
FIG. 2 is a top view of the instrument, together with the connections to a typical amplifier which may include a synthesizer.
FIG. 3 is a side view of the instrument.

In FIG. 1 there is indicated generally at 10 a performer using the instrument of the present invention, which itself is indicated generally at 20. Performer 10 is wearing a belt 12 which serves to support the lower portion of the instrument 20 by means of a bracket or hook indicated generally at 22 to be described in detail later. Instrument 20 is further supported on the body of the performer by a neck strap or band 14, which encircles the performers neck and upper chest and is connected by suitable means 16 to the upper portion of the instrument, and thus in cooperation with bracket hook 22 supports the instrument in proper playing position relative to the performer's body.

As seen in FIG. 2, instrument 20 includes an elongated fingerboard indicated generally at 24 terminating upwardly as seen in FIG. 2 in a headpiece indicated generally at 26 which includes a number of tensioning members 27, one for each of the nine strings of the present instrument. Fingerboard 24 is provided on its upper surface with a series of frets 28, each comprising a transverse rib on the upper surface of the fingerboard 24. The upper portion of fingerboard 24, headpiece 26 and its tensioning means 27, as well as frets 28, are conventional in design and construction. Downwardly as seen in FIG. 2, fingerboard 20 terminates in a lower extension indicated generally at 30 having mounted thereon a magnetic pickup assembly indicated generally at 32. As is well known in the art, the magnetic pickup assembly 32 serves to produce signals which are a function of the notes produced by strings on fingerboard 20, and feeds an output signal which is a function of the musical notes through a plug 33 and a cable 34 to an electrical amplifier and, optionally, a synthesizer, indicated generally at 36. The pickup assembly 32 may be provided with a volume control knob 38. The magnetic pickup assembly 32, plug 33, cable 34 and amplifier 36 are conventional and well known in the art.

The lowermost portion of lower extension 30 constitutes a conventional tail piece indicated generally at 39, to which the lower ends of the strings of the instrument are anchored in known manner.

Extending the entire length of fingerboard 24, headpiece 26 and tailpiece 30 is a group of strings 40, nine in number, and individually indicated at 41, 42, 43, 44, 45, 46, 47, 48 and 49. Each is anchored at its lower end to tailpiece 39, and is tensioned at its upper end by one of the tensioning means 27 carried on headpiece 26. As will be noted in FIG. 3, as is conventional, the strings extend slightly above the frets 28 formed on the upper surface of fingerboard 24.

As further seen in FIG. 3, there is provided, toward the lower end of fingerboard 24, a bracket or hook indicated generally at 50, having a base portion 51 fixed to the bottom surface of fingerboard 24, the base 51 forming one leg of fixed an inverted U-shaped member 52, whose other leg 53 is spaced from base leg 51, and slightly divergent relative to the base leg. Outwardly of leg 53 and attached thereto there may be provided an enlarged member 54 having a flat outer surface, which, as will be seen in FIG. 1, is adapted to rest against the body of the performer when the hook is engaged with the performer's belt 12 in use.

Figures 4, 5, 6, 7:
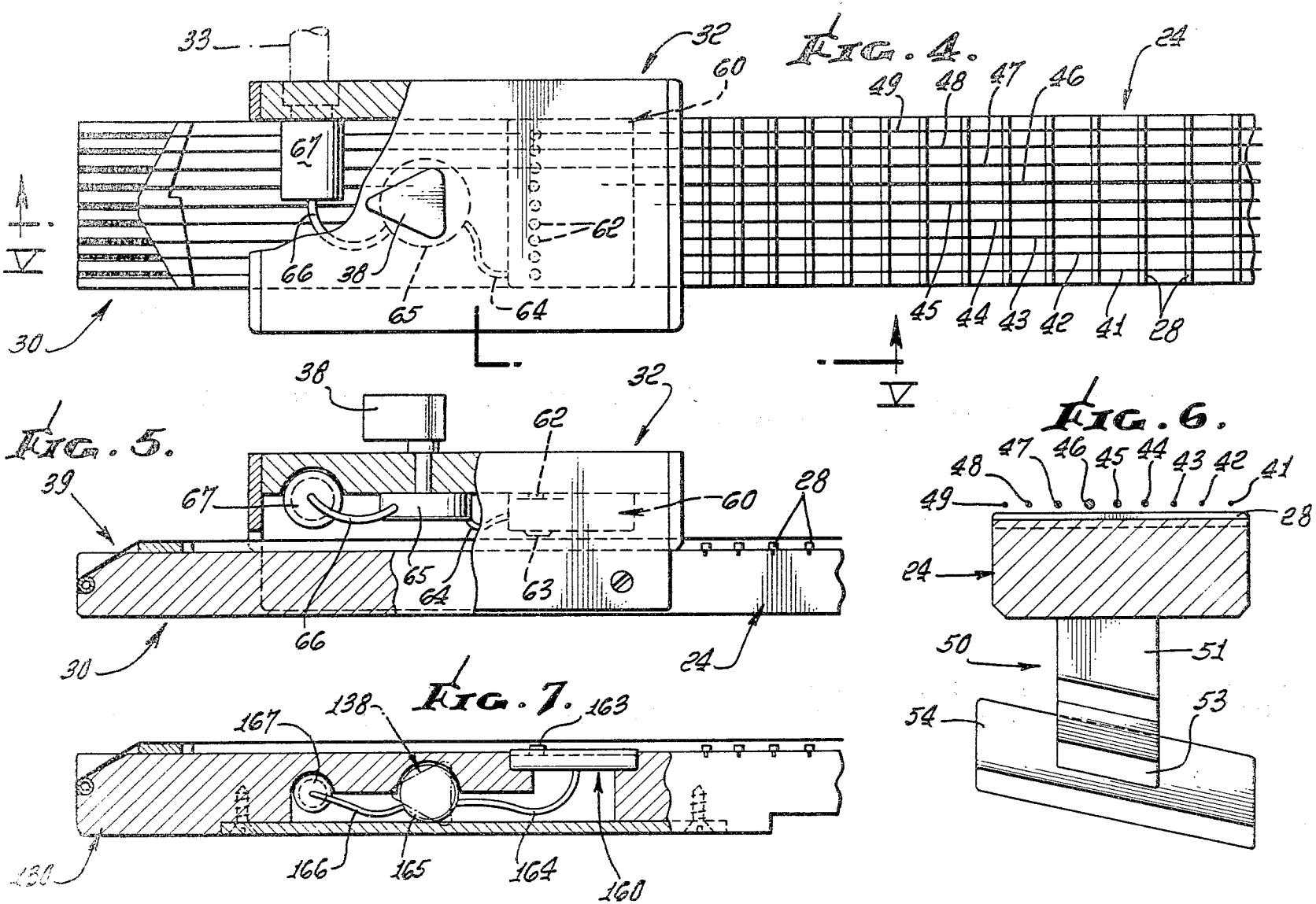
FIG. 4 is an enlarged view of the lower end of the fingerboard and the lower extension of the instrument, showing the magnetic pickup assembly, with part broken away for clarity of presentation.
FIG. 5 is a fragmentary sectional view taken on the arrows VI—VI of FIG. 4.
FIG. 6 is a sectional view taken on arrows VI—VI of FIG. 3.
FIG. 7 is a view similar to FIG. 5, except showing a modified form of the pickup assembly mounted on the lower extension of the instrument.

Support hook 50 will be seen in greater detail in FIG. 6, and it will be noted that the enlarged member 54 attached to the outer leg 53 is inclined relative to the plane of fingerboard 24 by an angle of between about 10° and 15°, in order to position the instrument 20 in proper orientation when the support hook is attached to the performer's belt slightly to the performer's right of the center of his body, as seen in FIG. 1.

A preferred arrangement of the magnetic pickup assembly 32 near the tailpiece 30 of the instrument will be seen in detail in FIGS. 4 and 5. Within assembly 32 is a case indicated generally at 60 in which are mounted individual magnetic pickups collectively indicated at 62, each pickup 62 being in vertical alignment with one of the strings 41–49, and immediately above its string. As seen in FIG. 5, each pickup 62 terminates downwardly in an adjustment screw 63 by which the effective distance separating the pickup head and its corresponding string can be selectively adjusted, whereby to vary the characteristics such as sensitivity, volume and the like. The output signals of the pickups 62 are fed through a cable 64 to a volume control device such as a potentiometer 65 which may be adjusted by the performer by knob 38 previously mentioned. The output of potentiometer 65 is fed through a cable 66 to a jack 67 into which plug 33 is received.

In FIG. 7 there is shown an alternative arrangement of the pickup assembly, in which all of the elements of the pickup circuitry are contained within the tailpiece indicated generally at 130. Thus a miniaturized pickup assembly indicated generally at 160 includes a plurality of individual pickups, each in adjacent alignment with one of the strings of the instrument, and each being desirably provided with an adjustable head, corresponding to head 63 previously described in connection with FIG. 5. Thus magnetic pickup adjusting head 163 may be selectively positioned vertically as seen in FIG. 7, relative to its string. The electrical output of the set of pickups in assembly 160 is fed through cable 164 to a volume adjustment means such as potentiometer 165 which is controlled by the performer by means of a knob 138. The output of potentiometer 165 is fed through cable 166 to a jack 167, to which a plug (not shown) may be inserted for connection to outside circuitry and amplifying equipment.

As previously pointed out, the tuning of the present instrument contemplates the provision of a lowest pitched string and a total of eight additional strings arranged in a melody set of five strings tuned in fourth intervals on one side of the lowest pitched string, and a chord and bass set including the lowest pitched string and three strings on the opposite side of the lowest pitched string.

There is thus provided a musical instrument of uniquely simple and inexpensive construction, and a novel tuning of the nine strings of the instrument in order to achieve desirable musical effects during playing. Preferably the strings are tuned as follows:

| String | Pitch |
|---|---|
| 41 | E flat |
| 42 | B flat |
| 43 | F |
| 44 | C below middle C |
| 45 | G |
| 46 | A flat |
| 47 | E flat |
| 48 | B flat |
| 49 | F |

It will be understood that the highest pitched string of either or both of the melody set or the bass and chord set could be omitted without foregoing the advantages of the uniform intervals of perfect fourths in the tuning of the strings of the melody set and of the uniform intervals of perfect fifths in the tuning of the strings of the bass and chord set. Thus an instrument having seven or eight strings, differing from the preferred embodiment by the omission of the highest pitched string of either or both of the sets would be capable of producing acceptable music, although of a somewhat diminished range compared to the use of nine strings as herein disclosed.

In accordance with the present invention, an instrument such as hereinabove set forth is played with the fingers of both of the user's hands directly tapping the strings and holding them against selected frets, this thereby increases the chordal, melodic and contrapuntal possibilities for producing a full, orchestral sound. The two hands of the player are free to engage the strings of the disclosed instrument, and the player or performer plays the instrument by playing bass, chords and melody simultaneously, with the noted finger tapping of the strings. On the disclosed instrument, melody is played almost exclusively by the tapping of the first five strings, comprising a first group of strings, with the fingers of the right hand. A second group of strings, comprising the other four strings of the disclosed instrument, are used for playing the bass and chord strings, by tapping.

The term "tapping" as used herein includes not only tapping, but the holding of at least one string against a selected fret, and it is also contemplated that one finger at one fret can tap and hold two or more strings at the same time. This technique allows easy and natural double, triple or quadruple fourths or fifths in musical intervals, such intervals fitting in well with more complex chords. This is a capability which will be understood by the musician to be a result of the above described string tuning, which can be exploited with the left hand, thereby allowing for ease of chording, and enabling the performer to give more concentration to right-hand melody.

Modifications and changes of the herein disclosed inventive subject matter are intented to be embraced within the scope of the appended claims.

I claim:

1. A method of playing by a performer a musical instrument of a type comprising a fretted fingerboard with fixed frets, a plurality of tensioned strings extending in adjacent spaced relation to the fretted fingerboard, and string tensioning means, said method being the playing of the said instrument by a performer substantially exclusively by engaging the strings directly by the fingers, the engaging being by tapping by fingers of both hands substantially simultaneously the said strings and holding said strings against selected frets by fingers of both hands.

2. The method of claim 1, wherein said instrument has plural strings of which a first group of strings is "melody" tuned and a second group of strings is "bass and chord" strings, and wherein the strings of the first group are tapped and held by fingers of the right hand and the strings of the second group are tapped and held by fingers of the left hand.

3. The method of claim 1, wherein said strings comprise bass, chords and melody, and, wherein bass, chords and melody are played simultaneously.

4. The method of claim 1, further comprising electrically amplifying the sound generated by said tapping.

* * * * *

REEXAMINATION CERTIFICATE (731st)

United States Patent [19] [11] B1 4,142,436

Chapman [45] Certificate Issued Jul. 21, 1987

[54] METHOD OF PLAYING STRINGED MUSICAL INSTRUMENT

[76] Inventor: Emmett H. Chapman, 8320 Yucca Trail, Los Angeles, Calif. 90046

Reexamination Request:
No. 90/000,469, Nov. 18, 1983

Reexamination Certificate for:

| | |
|---|---|
| Patent No.: | **4,142,436** |
| Issued: | **Mar. 6, 1979** |
| Appl. No.: | **746,027** |
| Filed: | **Nov. 30, 1976** |

Related U.S. Application Data

[60] Continuation of Ser. No. 552,080, Feb. 28, 1975, abandoned, which is a division of Ser. No. 457,396, Apr. 3, 1974, Pat. No. 3,868,880, which is a division of Ser. No. 334,859, Feb. 22, 1973, Pat. No. 3,833,751.

[51] Int. Cl.[4] ..... G10D 3/06; G10H 3/18

[52] U.S. Cl. ..... 84/1.16; 84/173; 84/314 R; 84/DIG. 30

[58] Field of Search ..... 84/1.16, 173, 267–269, 84/284, 285, 312 R, 314, DIG. 30, 327, 453

[56] References Cited

U.S. PATENT DOCUMENTS

| | | | |
|---|---|---|---|
| 2,989,884 | 6/1961 | Bunker | 84/1.16 |
| 3,371,570 | 3/1968 | Lester | 84/327 |
| 3,512,443 | 5/1970 | Parson et al. | 84/327 X |

OTHER PUBLICATIONS

Leonard Feather, "Emmett Chapman Gets on the Stick", *The Los Angeles Times,* Calendar section, Jun. 23, 1985, pp. 83, 86–87.

*ASCAP Biographical Dictionary,* 4th ed., R. R. Bowker Company, New York (1980), p. 152, title page, copyright page and contents page.

Leonard Feather, *The Book of Jazz Then Till Now,* copyright page, contents page, page listing "Other Books of Leonard Feather", and chaper 13, pp. 110–118.

Dave Crombie, "Just What, We Ask, is Chapman's Stick?", *Melody Maker,* Dec. 29, 1979, p. 25.

Dr. William L. Fowler, "How to Understand the Stick", down beat, Sep. 11, 1975, p. 42.

Eric Larson, "Resurrection of A One-Man Band", *News and Review,* Apr. 6, 1978.

Pat Asher, "Emmett Chapman, Stick Inventor and Virtuoso", *Streetscene,* Sep. 1983, p. 12–13.

*Bam,* Reviews, Jan. 27, 1984.

*Guitar Player Magazine,* vol. one, 1967, Guitar Player Productions, Saratoga, California.

RCA Victor LSP-1942, "Web'ster's un'a-bridged'" by Radio Corporation of America, 1959.

Jimmie Webster, *Illustrated "Touch System" for Electric and Amplified Spanish Guitar,* Wm. J. Smith Music Co., Inc., New York, N.Y., 1952.

*Primary Examiner*—Stanley J. Witkowski

[57] ABSTRACT

A method for playing a stringed musical instrument of the guitar family by tapping the strings. The musical instrument has, for example, a fretted fingerboard, a plurality of tensioned strings and string tensioning means, sound amplifying means; there is a first group of melody tuned strings and a second group of bass and chord strings. The strings of the first group are tapped by the fingers of the right hand and the strings of the second group are tapped by the fingers of the left hand. The fingers of both hands are used to tap bass, chords and melody simultaneously.

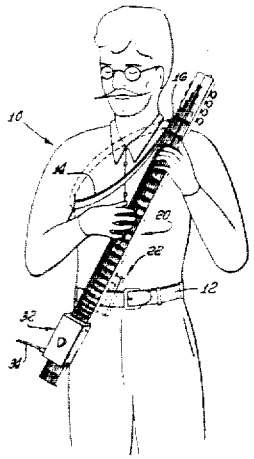

REEXAMINATION CERTIFICATE ISSUED UNDER 35 U.S.C. 307

THE PATENT IS HEREBY AMENDED AS INDICATED BELOW.

AS A RESULT OF REEXAMINATION, IT HAS BEEN DETERMINED THAT:

Claims 1–4 are cancelled.

* * * * *